US005743772A

United States Patent [19]

Assawah et al.

[11] Patent Number: 5,743,772

[45] Date of Patent: Apr. 28, 1998

[54] MANUALLY DRIVEN WATER PROPULSION DEVICE

[76] Inventors: Wagdy A. Assawah; Nader W. Assawah, both of 17 Penn Valley Rd. Apt. D-4, Levittown, Pa. 19054

[21] Appl. No.: 854,319

[22] Filed: May 12, 1997

[51] Int. Cl.[6] ..... B63H 16/20

[52] U.S. Cl. ..... 440/28; 440/31; 441/124

[58] Field of Search ..... 114/315; 441/65, 441/74, 79, 124; 440/21, 26, 28, 31, 49

[56] References Cited

U.S. PATENT DOCUMENTS 3,133,522 5/1964 Nicolaie ..... 440/28
3,323,481 6/1967 Harvey ..... 114/315
3,570,436 3/1971 Le Vasseur ..... 114/315
4,289,487 9/1981 Fattler ..... 440/31
5,619,948 4/1997 Keyvani ..... 114/315

*Primary Examiner*—Stephen Avila

[57] ABSTRACT

A manually driven water propulsion device including a propulsion assembly comprising an attachment strap, a gearbox, a flexible shaft, a propeller, securing booties and bootie attachment member, the attachment strap being configured as a loop, in an operative orientation the attachment strap being coupled to the gearbox and fastened around a user's waist, the gearbox having a lower surface, a top, a bottom; and a gear assembly being positioned within the gearbox for affording rotation of the shaft and propeller, the bootie attachment member rotatably coupled to the shaft and adapted to allow releasable coupling with the securing booties.

9 Claims, 3 Drawing Sheets

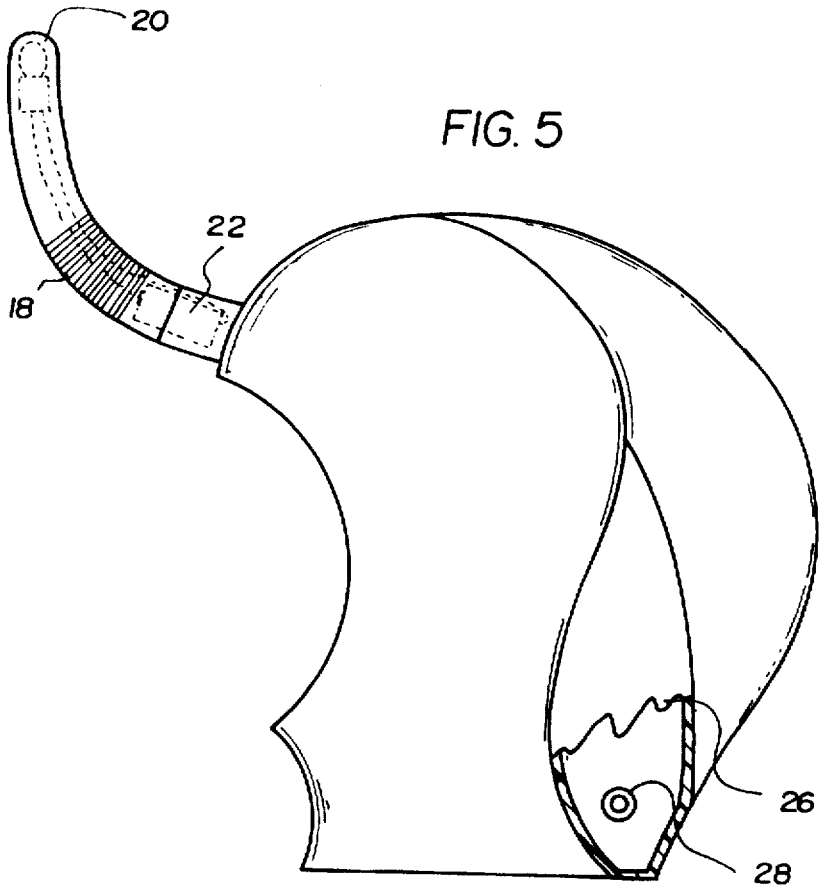
FIG. 5
FIG. 6
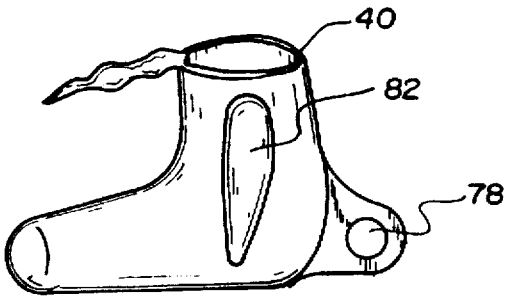
FIG. 7
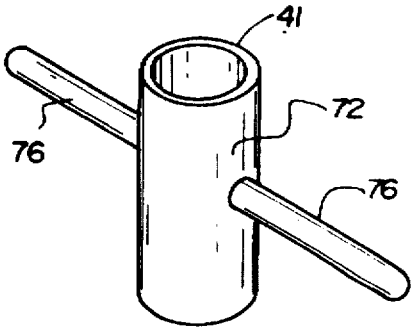

MANUALLY DRIVEN WATER PROPULSION DEVICE

BACKGROUND OF THE INVENTION

1. Field of the Invention

The present invention relates to a manually driven water propulsion device and more particularly pertains to enabling a user to propel himself through the water while floating on his back.

2. Description of the Prior Art

The use of swimming devices is known in the prior art. More specifically, swimming devices heretofore devised and utilized for the purpose of enhancing water activities are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,289,487 to Fattier discloses a swimming device. U.S. Pat. No. 4,158,245 to Cunningham discloses a swimming device. U.S. Pat. No. Des. 292,694 to Panyik discloses a water craft. U.S. Pat. No. 5,396,830 to Cheng discloses a swimming propelling device. U.S. Pat. No. 5,024,178 to Bruce discloses a underwater propulsion device. U.S. Pat. No. 4,182,788 to Turnier discloses a swimming and exercising apparatus.

While these devices fulfill their respective, particular objective and requirements, the aforementioned patents do not describe a manually driven water propulsion device for enabling a user to propel himself through the water while floating on his back.

In this respect, the manually driven water propulsion device according to the present invention substantially departs from the conventional concepts and designs of the prior art, and in so doing provides an apparatus primarily developed for the purpose of enabling a user to propel himself through the water while floating on his back.

Therefore, it can be appreciated that there exists a continuing need for a new and improved manually driven water propulsion device which can be used for enabling a user to propel himself through the water while floating on his back. In this regard, the present invention substantially fulfills this need.

SUMMARY OF THE INVENTION

In view of the foregoing disadvantages inherent in the known types of swimming devices now present in the prior art, the present invention provides an improved manually driven water propulsion device. As such, the general purpose of the present invention, which will be described subsequently in greater detail, is to provide a new and improved manually driven water propulsion device which has all the advantages of the prior art and none of the disadvantages.

To attain this, the present invention essentially comprises a helmet formed in an elongated semi-circular configuration with a closed top, an open bottom, a front portion and a rear portion, the front portion having an upper region including a light formed in an elongated cylindrical configuration with a hollow interior, the light including a light bulb and one battery at a base thereof, the front portion having a lower region including a large, generally oval shaped face aperture therethrough, the rear portion including a head float attached thereto, the head float having a generally hollow interior and including a plug; a propulsion assembly comprising an attachment strap, a gearbox, a telescopic shaft with an upper portion and a lower portion, a propeller, securing booties, and bootie attachment member, the attachment strap being formed in an elongated rectangular shape and being configured as a loop, in an operative orientation the attachment strap being coupled around a user's waist, the gearbox being formed in a generally rectangular configuration with an upper surface, a lower surface, a top, a bottom and a generally hollow interior, the attachment strap being coupled to the upper surface of the gear box, a hand crank including a handle extending from the lower surface of the gearbox; and a bevel gear assembly being positioned within the gearbox, the bevel gear assembly including a large gear operatively coupled to the hand crank and a small gear operatively coupled to the upper portion of the telescopic shaft, the bevel gears being positioned perpendicular with respect to each other, the upper portion of the telescopic shaft being slidably coupled within the lower portion of the telescopic shaft, the lower portion including adjustment means comprising a set screw adapted to fixedly engage the upper position of the telescopic shaft with the lower portion thereof, the propeller being formed as a generally circular central section with three elongated blades projecting therefrom, the propeller being coupled to the lower portion of the telescopic shaft, the bootie attachment member having a first hollow cylindrical member rotatably coupled to the lower portion of the telescopic shaft and a pair of second cylindrical members integrally coupled perpendicularly to the first cylindrical member for releasably inserting within a pair of third hollow members coupled to a heel portion of each of the securing booties, each securing bootie having a foot float attached thereto, in an operative orientation a user positioning the helmet around his head, positioning the attachment strap around his waist, positioning the securing booties over his feet, coupling the booties to the bootie attachment member and the user then floating on his back and turning the handle, this action causing rotation of the bevel gears thereby rotating the telescopic shaft and propeller.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved manually driven water propulsion device which has all the advantages of the prior art swimming devices and none of the disadvantages.

It is another object of the present invention to provide a new and improved manually driven water propulsion device which may be easily and efficiently manufactured and marketed.

It is a further object of the present invention to provide a new and improved manually driven water propulsion device which is of a durable and reliable construction.

An even further object of the present invention is to provide a new and improved manually driven water propulsion device which is susceptible of a low cost of manufacture with regard to both materials and labor, and which accordingly is then susceptible of low prices of sale to the consuming public, thereby making such manually driven water propulsion device economically available to the buying public.

Still yet another object of the present invention is to provide a new and improved manually driven water propulsion device which provides in the apparatuses and methods of the prior art some of the advantages thereof, while simultaneously overcoming some of the disadvantages normally associated therewith.

Still another object of the present invention is to enable a user to propel himself through the water while floating on his back.

Lastly, it is an object of the present invention to provide a new and improved manually driven water propulsion device including a propulsion assembly comprising an attachment strap, a gearbox, a flexible shaft, a propeller, securing booties and bootie attachment member, the attachment strap being configured as a loop, in an operative orientation the attachment strap being coupled to the gearbox and fastened around a user's waist, the gearbox having a lower surface, a top, a bottom; and a gear assembly being positioned within the gearbox for affording rotation of the shaft and propeller, the bootie attachment member rotatably coupled to the shaft and adapted to allow releasable coupling with the securing booties.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a side view of the helmet of the present invention with a portion of the head float thereof cut away.

FIG. 6 is a side view of one of the booties of the present invention.

FIG. 7 is a perspective view of the bootie attachment member of the present invention.

Similar reference characters refer to similar parts throughout the several views of the drawings.

DESCRIPTION OF THE PREFERRED EMBODIMENT

Figure 1:
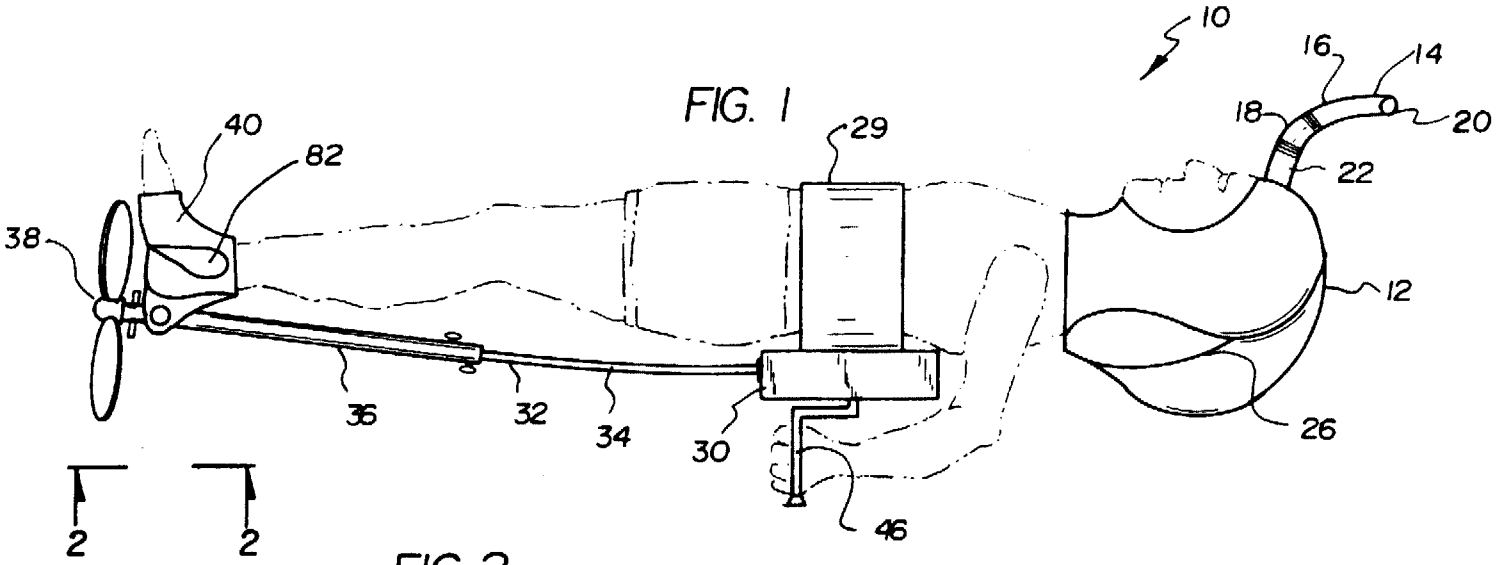
FIG. 1 is a perspective illustration of the preferred embodiment of the manually driven water propulsion device constructed in accordance with the principles of the present invention.

With reference now to the drawings, and in particular, to FIG. 1 thereof, the preferred embodiment of the new and improved manually driven water propulsion device embodying the principles and concepts of the present invention and generally designated by the reference number 10 will be described.

Specifically, it will be noted in the various Figures that the device relates to a new and improved manually driven water propulsion device 10. In its broadest context, the device consists of a helmet, a gear box, a telescopic shaft, and a propeller. Such components are individually configured and correlated with respect to each other so as to attain the desired objective.

The system 10 of the present invention incudes a helmet 12 formed in an elongated semi-circular configuration with a closed top, an open bottom, a front portion and a rear portion. As shown in FIGS. 1 & 5, the front portion has an upper region including a light 14. The light is situated in a light tube 16 formed in an elongated cylindrical configuration with a hollow interior. The light tube is preferably flexible with bellowed side surfaces 18 to allow for the adjustment thereof. The light includes a light bulb 20 and one battery 22 at a base of the light tube. The unique placement of the battery affords optimal flexibility of the remaining portion of the light tube. A lower region of the helmet includes a large, generally oval shaped face aperture therethrough. The rear portion includes a head float 26 attached thereto. As shown in FIG. 5, the head float has a generally hollow interior and includes a plug 28.

Figure 3:
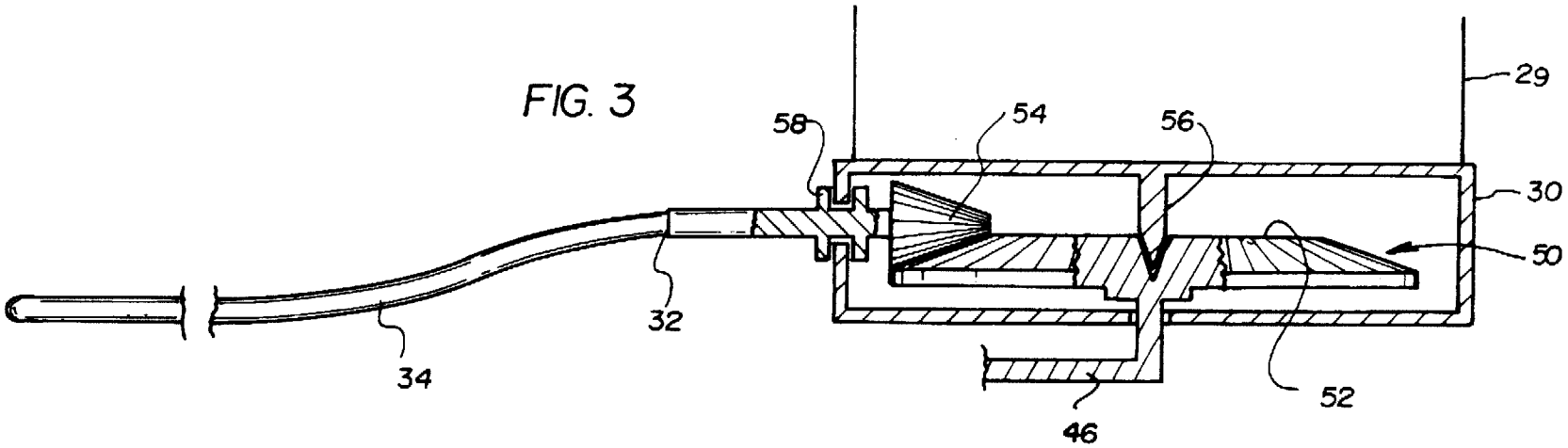
FIG. 3 is a vertical-sectional view of the gear box of the present invention.

Next provided is a propulsion assembly comprising an attachment strap 29, a gearbox 30, a telescopic shaft 32 with an upper portion 34 and a lower portion 36, a propeller 38, securing booties 40, and bootie attachment member 41. The attachment strap is formed in an elongated rectangular shape and is configured as a loop. As such, in an operative orientation, the attachment strap is coupled around a user's waist. See FIG. 1. The gearbox is formed in a generally rectangular configuration with an upper surface, a lower surface, a top, a bottom and a generally hollow interior. The attachment strap is coupled to the upper surface of the gear box. As shown in FIG. 3, an L-shaped hand crank 46 extends from the lower surface of the gearbox.

Further provided is a bevel gear assembly 50 being positioned within the gearbox. The bevel gear assembly includes a large gear 52 operatively coupled to the hand crank and a small gear 54 operatively coupled to the upper portion of the telescopic shaft. Such coupling of the large gear is afforded by means of a pin 56 which is rotatably inserted within an indent centrally formed in the large gear. With regard to the small gear, a pair of spaced annular rings 58 are rotatably coupled about an aperture formed in the housing. The bevel gears are positioned perpendicularly with respect to each other. It should be noted that bearings are not necessary in the present invention due to the lubricating characteristics of the water surrounding the present invention during use.

Figure 4:
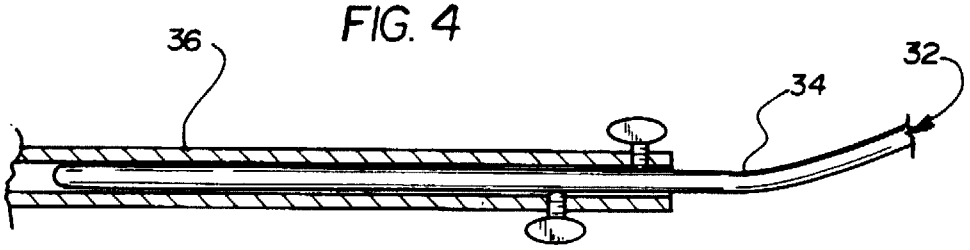
FIG. 4 is a longitudinal-sectional view of the middle part of the telescopic shaft of the present invention.

As shown in FIG. 4, the upper portion of the telescopic shaft is slidably coupled within the lower portion of the telescopic shaft. In the preferred embodiment, the upper portion is constructed from braided threads allowing it to bend but not to twist. The lower portion includes adjustment means comprising a set screw 62 adapted to allow a user to selectively and fixedly couple the upper portion of the telescopic shaft with the lower portion thereof. As will become apparent later, such adjustment accommodates users of various heights. In the preferred embodiment, the propeller is formed with a generally circular central section and three elongated blades projecting therefrom. The propeller is fixedly coupled to the lower portion of the telescopic shaft for rotation upon the rotation of the telescopic shaft.

Figure 2:
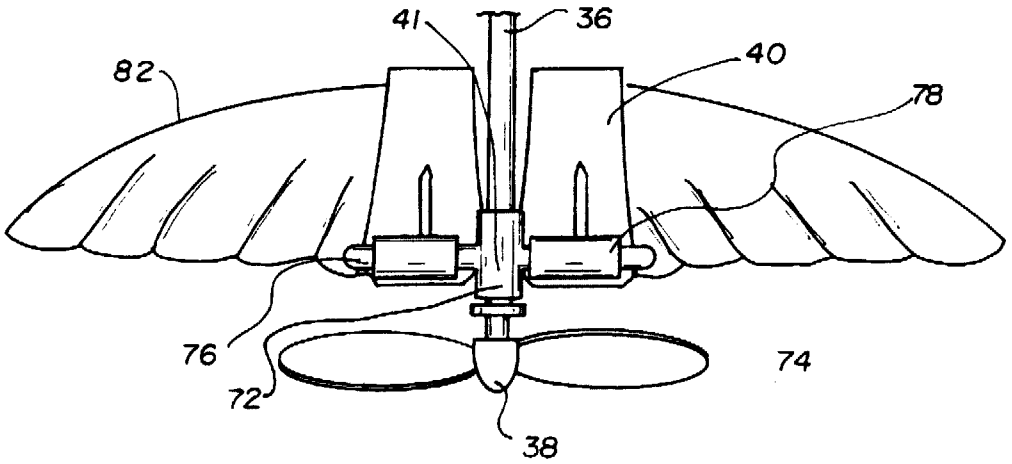
FIG. 2 is a rear view of the booties, bootie attachment member, and telescopic shaft of the present invention.

As shown in FIG. 7, the bootie attachment member 41 has a first hollow cylindrical member 72 rotatably coupled to the lower portion of the telescopic shaft. Such first cylindrical member is maintained on the lower portion of the telescopic shaft by means of an annular flange 74 formed on a bottom end of the shaft. Note FIGS. 1 & 2. A pair of second cylindrical members 76 are integrally coupled perpendicular to the first cylindrical member for being releasably inserted within a pair of third hollow members 78 coupled to a heel portion 80 of each of the securing booties. Note FIG. 6. The securing booties are further equipped with foot float shaped as fins 82 extending outward from side portions thereof. Such float works in conjunction with the helmet to maintain the user afloat during use of the present invention.

In operation, a user positions the helmet around his head and situates the attachment strap around his waist. Subsequently, the securing booties are positioned over his feet. Next, the booties are attached to the bootie attachment member and the user then floats on his back while turning the handle. Such action causes rotation of the bevel gears thereby rotating the telescopic shaft and propeller. When the present invention is not in use, the bootie attachment member may be released from the booties and the flexible telescopic shaft may be held while the user walks on land.

In an alternate embodiment, the hand crank may be replaced with a motor for providing automatic rotation of the propeller.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved manually driven water propulsion device comprising, in combination:

a helmet formed in an elongated semi-circular configuration with a closed top, an open bottom, a front portion and a rear portion, the front portion having an upper region including a light formed in an elongated cylindrical configuration with a hollow interior, the light including a light bulb and one battery at a base thereof, the front portion having a lower region including a large, generally oval shaped face aperture therethrough, the rear portion including a head float attached thereto, the head float having a generally hollow interior and including a plug;

a propulsion assembly comprising an attachment strap, a gearbox, a telescopic shaft with an upper portion and a lower portion, a propeller, securing booties, and bootie attachment member, the attachment strap being formed in an elongated rectangular shape and being configured as a loop, in an operative orientation the attachment strap being coupled around a user's waist, the gearbox being formed in a generally rectangular configuration with an upper surface, a lower surface, a top, a bottom and a generally hollow interior, the attachment strap being coupled to the upper surface of the gear box, a hand crank including a handle extending from the lower surface of the gearbox; and a bevel gear assembly being positioned within the gearbox, the bevel gear assembly including a large gear operatively coupled to the hand crank and a small gear operatively coupled to the upper portion of the telescopic shaft, the bevel gears being positioned perpendicular with respect to each other, the upper portion of the telescopic shaft being slidably coupled within the lower portion of the telescopic shaft, the lower portion including adjustment means comprising a set screw adapted to fixedly engage the upper position of the telescopic shaft with the lower portion thereof, the propeller being formed as a generally circular central section with three elongated blades projecting therefrom, the propeller being coupled to the lower portion of the telescopic shaft, the bootie attachment member having a first hollow cylindrical member rotatably coupled to the lower portion of the telescopic shaft and a pair of second cylindrical members integrally coupled perpendicularly to the first cylindrical member for releasably inserting within a pair of third hollow members coupled to a heel portion of each of the securing booties, each securing bootie having a foot float attached thereto, in an operative orientation a user positioning the helmet around his head, positioning the attachment strap around his waist, positioning the securing booties over his feet, coupling the booties to the bootie attachment member and the user then floating on his back and turning the handle, this action causing rotation of the bevel gears thereby rotating the telescopic shaft and propeller.

2. A manually driven water propulsion device comprising, in combination:

a propulsion assembly comprising an attachment strap, a gearbox, a shaft with an upper portion and a lower portion, a propeller and securing booties, the attachment strap being configured as a loop, in an operative orientation the attachment strap being coupled to the gearbox and fastened around a user's waist, the gearbox having a lower surface, a top, a bottom, a hand crank including a handle extending from the lower surface of the gearbox; and a bevel gear assembly being positioned within the gearbox, the bevel gear assembly including a large gear operatively coupled to the hand crank and a small gear operatively coupled to the upper portion of the shaft, the upper portion of the shaft being coupled within the lower portion of the shaft, the propeller being formed with a central section having a plurality of blades projecting therefrom, the propeller being coupled to the lower portion of the shaft, in an operative orientation a user positioning the attachment strap around his waist then floating on his back and turning the handle, this action causing rotation of the bevel gears thereby rotating the shaft components and propeller.

3. The manually driven water propulsion device as set forth in claim 2 and further including:

a helmet with a front portion and a rear portion, the front portion including a large, generally oval shaped face aperture therethrough, the rear portion including at least one buoyant head floats attached thereto.

4. The manually driven water propulsion device as set forth in claim 3 wherein the front portion of the helmet has an upper region including a light situated in a light tube formed in an elongated cylindrical configuration with a hollow interior, the light further including a light bulb and a battery.

5. The manually driven water propulsion device as set forth in claim 2 and further including adjustment means for fixedly coupling the lower portion of the telescoping shaft with respect to the upper portion, wherein the upper portion is in telescopic relationship with the lower portion.

6. The manually driven water propulsion device as set forth in claim 2 wherein each securing bootie having a foot float a fin attached thereto.

7. A manually driven water propulsion device comprising, in combination:

propulsion assembly comprising an attachment strap, a gearbox, a flexible shaft, a propeller, securing booties and bootie attachment member, the attachment strap being configured as a loop, in an operative orientation the attachment strap being coupled to the gearbox and fastened around a user's waist, the gearbox having a lower surface, a top, a bottom; and a gear assembly being positioned within the gearbox for affording rotation of the shaft and propeller, the bootie attachment member rotatably coupled to the shaft and adapted to allow releasable coupling with the securing booties.

8. The manually driven water propulsion device as set forth in claim 7 wherein the bootie attachment member has a first hollow cylindrical member rotatably coupled to the lower portion of the telescopic shaft and a pair of second cylindrical members integrally coupled perpendicular to the first cylindrical member for releasably inserting within a pair of third hollow members coupled to a heel portion of each of the securing booties.

9. The manually driven water propulsion device as set forth in claim 7 wherein the device provides a new method to incorporate a propeller in juxtaposition of the heels of a user to propel himself on water-surfaces.

* * * * *